US009133841B2

(12) United States Patent
Twidale et al.

(10) Patent No.: US 9,133,841 B2
(45) Date of Patent: Sep. 15, 2015

(54) PROGRESSING CAVITY STATOR WITH METAL PLATES HAVING APERTURES WITH ENGLARGED ENDS

(71) Applicant: Cameron International Corporation, Houston, TX (US)

(72) Inventors: Derek L. Twidale, Cypress, TX (US); Majid S. Delpassand, Houston, TX (US); Leonard J. Vogel, Tomball, TX (US); Allen T. Le, Missouri City, TX (US)

(73) Assignee: Cameron International Corporation, Houston, TX (US)

( * ) Notice: Subject to any disclaimer, the term of this patent is extended or adjusted under 35 U.S.C. 154(b) by 134 days.

(21) Appl. No.: 13/861,248

(22) Filed: Apr. 11, 2013

(65) Prior Publication Data

US 2014/0308145 A1 Oct. 16, 2014

(51) Int. Cl.

| | |
|---|---|
| ***F04C 2/00*** | (2006.01) |
| ***F04C 13/00*** | (2006.01) |
| ***F04C 2/107*** | (2006.01) |

(52) U.S. Cl.

CPC ..... *F04C 13/008* (2013.01); *F04C 2/1075* (2013.01); *F04C 2240/70* (2013.01); *Y10T 29/49826* (2015.01)

(58) Field of Classification Search

CPC ..... F04C 13/008; F04C 2240/70; F04C 2/107–2/1078; F04C 18/1075

USPC ..... 418/48–53, 150, 176; 29/428, 888.02, 29/888.023, 889.22

See application file for complete search history.

(56) References Cited

U.S. PATENT DOCUMENTS

| | | | | |
|---|---|---|---|---|
| 3,975,121 | A * | 8/1976 | Tschirky | 418/48 |
| 5,007,490 | A | 4/1991 | Ide | |
| 5,007,491 | A | 4/1991 | Ide | |
| 5,358,390 | A | 10/1994 | Jäger | |
| 5,807,087 | A | 9/1998 | Brandt et al. | |
| 5,832,604 | A | 11/1998 | Johnson et al. | |
| 6,158,988 | A | 12/2000 | Jäger | |

(Continued)

FOREIGN PATENT DOCUMENTS

| | | | |
|---|---|---|---|
| DE | 2712121 | A1 * | 9/1978 |
| FR | 2299533 | B3 * | 10/1977 |

(Continued)

OTHER PUBLICATIONS

Vetter, G. and Wirth, W. (1995). "Understand Progressing Cavity Pumps Characteristics And Avoid Abrasive Wear." Proceedings of the 12th International Pump Users Symposium. Pump Users Symposium. Houston.*

(Continued)

*Primary Examiner* — Thomas Denion
*Assistant Examiner* — Laert Dounis
(74) *Attorney, Agent, or Firm* — Eubanks PLLC

(57) ABSTRACT

Progressing cavity devices and systems are provided. In one embodiment, a system includes a metal stator of a progressing cavity device. The metal stator includes metal plates with apertures that are rotationally offset to form a winding rotor cavity. At least one of the apertures that form the winding rotor cavity has an elongated profile with enlarged ends having widths greater than that across the middle of the at least one aperture. Additional systems, devices, and methods are also disclosed.

18 Claims, 7 Drawing Sheets

(56) References Cited

U.S. PATENT DOCUMENTS

| | | | |
|---|---|---|---|
| 6,241,494 | B1 | 6/2001 | Pafitis et al. |
| 6,293,358 | B1 | 9/2001 | Jäger |
| 6,427,787 | B1 | 8/2002 | Jäger |
| 6,498,232 | B1 | 12/2002 | Güntherberg et al. |
| 6,604,921 | B1 | 8/2003 | Plop et al. |
| 6,604,922 | B1 | 8/2003 | Hache |
| 6,666,668 | B1 | 12/2003 | Kaechele |
| 7,083,401 | B2 | 8/2006 | Hooper |
| 7,192,260 | B2 | 3/2007 | Lievestro et al. |
| 7,354,258 | B2 | 4/2008 | Jäger |
| 7,396,220 | B2 | 7/2008 | Delpassand et al. |
| 7,517,202 | B2 | 4/2009 | Delpassand |
| 2005/0089429 | A1 | 4/2005 | Delpassand et al. |
| 2005/0285305 | A1 | 12/2005 | Neuroth |
| 2006/0182643 | A1 | 8/2006 | Delpassand |
| 2006/0216178 | A1 | 9/2006 | Sindt et al. |
| 2008/0025859 | A1 | 1/2008 | Lee et al. |
| 2008/0050259 | A1 | 2/2008 | Hooper |
| 2008/0304991 | A1 | 12/2008 | Speckert |
| 2008/0304992 | A1 | 12/2008 | Hooper et al. |
| 2009/0078426 | A1 | 3/2009 | Blaquiere |
| 2009/0110579 | A1 | 4/2009 | Amburgey |
| 2010/0019610 | A1 | 1/2010 | Saban et al. |
| 2010/0086425 | A1 | 4/2010 | Steele |
| 2010/0284842 | A1 | 11/2010 | Jager |
| 2014/0134029 | A1* | 5/2014 | Coghlan et al. ..... 418/48 |

FOREIGN PATENT DOCUMENTS

| | | | |
|---|---|---|---|
| GB | 2021199 | A * | 11/1979 |
| GB | 1567880 | | 5/1980 |

OTHER PUBLICATIONS

Thomas, International Search Report and Written Opinion for PCT/US2014/033350, mailed Aug. 29, 2014.

* cited by examiner

PROGRESSING CAVITY STATOR WITH METAL PLATES HAVING APERTURES WITH ENGLARGED ENDS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, pumps, fluid conduits, and the like, that control drilling or extraction operations.

In some instances, resources accessed via wells are able to flow to the surface by themselves. This is typically the case with gas wells, as the accessed gas has a lower density than air. This can also be the case for oil wells if the pressure of the oil is sufficiently high to overcome gravity. But often accessed oil does not have sufficient pressure to flow to the surface and the oil must be lifted to the surface through one of various methods known as artificial lift. Artificial lift can also be used to raise other resources through wells to the surface, or for removing water or other liquids from gas wells. Some forms of artificial lift use a pump that is placed downhole in the well. In some instances, the pump is a progressing cavity pump having a stator that cooperates with a helical rotor to draw fluid up the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to progressing cavity devices, such as progressing cavity pumps. More specifically, in various embodiments such a progressing cavity device includes a metal stator formed with a series of discs having apertures. The discs are rotationally offset with respect to one another such that the apertures form a winding rotor cavity with a stepped surface through the stator. In some embodiments, the apertures that form the rotor cavity have profiles including deviations that enhance the fit of the rotor within the stepped rotor cavity and improve the efficiency of the progressing cavity device.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
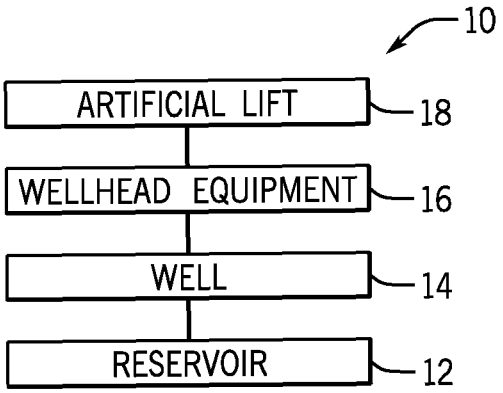
FIG. 1 generally depicts a production system having an artificial lift apparatus to draw fluid from a well to the surface in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well (e.g., attached to the top of casing and tubing strings in the well). In one embodiment, the wellhead equipment 16 includes a casing head and a tubing head. But the components of the wellhead equipment 16 can differ between applications, and such equipment could include various casing heads, tubing heads, stuffing boxes, pumping tees, and pressure gauges, to name only a few possibilities.

Figure 2:
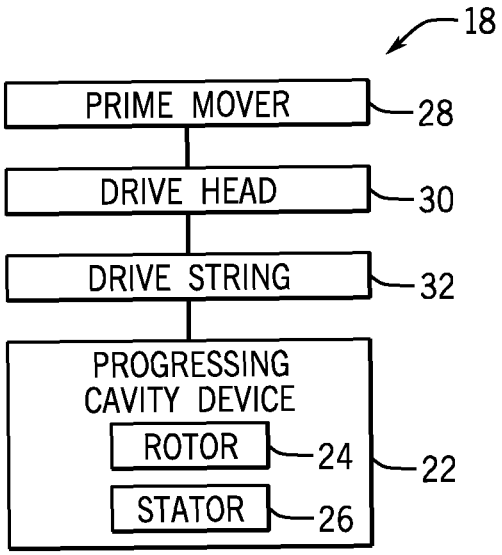
FIG. 2 is a block diagram of various components of the artificial lift apparatus of FIG. 1, including a progressing cavity device, in accordance with one embodiment.

The system 10 also includes an artificial lift apparatus 18. In one embodiment generally depicted in FIG. 2, the artificial lift apparatus 18 includes a progressing cavity device 22 that operates as a downhole pump in the well 14. The progressing cavity device 22 includes a rotor 24 and a stator 26. In the presently depicted embodiment, in which the progressing cavity device 22 operates as a pump of the artificial lift apparatus 18, the rotor 24 rotates with respect to the stator 26 to pump fluid through the device 22 and from the reservoir 12 to the surface through the well 14.

The apparatus 18 also includes a prime mover 28 that cooperates with a drive head 30 to rotate a drive string 32 that extends downward through the well 14 to the progressing cavity device 22. The prime mover 28 and the drive head 30 can be provided at the surface—mounted to the wellhead equipment 16, for example. The prime mover 28 can be provided in any suitable form, such as a diesel engine, a gas engine, or an electric motor. The drive head 30 can include a gear box to reduce rotational output from the prime mover 28 so that the drive string 32 (e.g., a sucker-rod string) rotates at a speed appropriate for operating the progressing cavity device 22.

Figure 3:
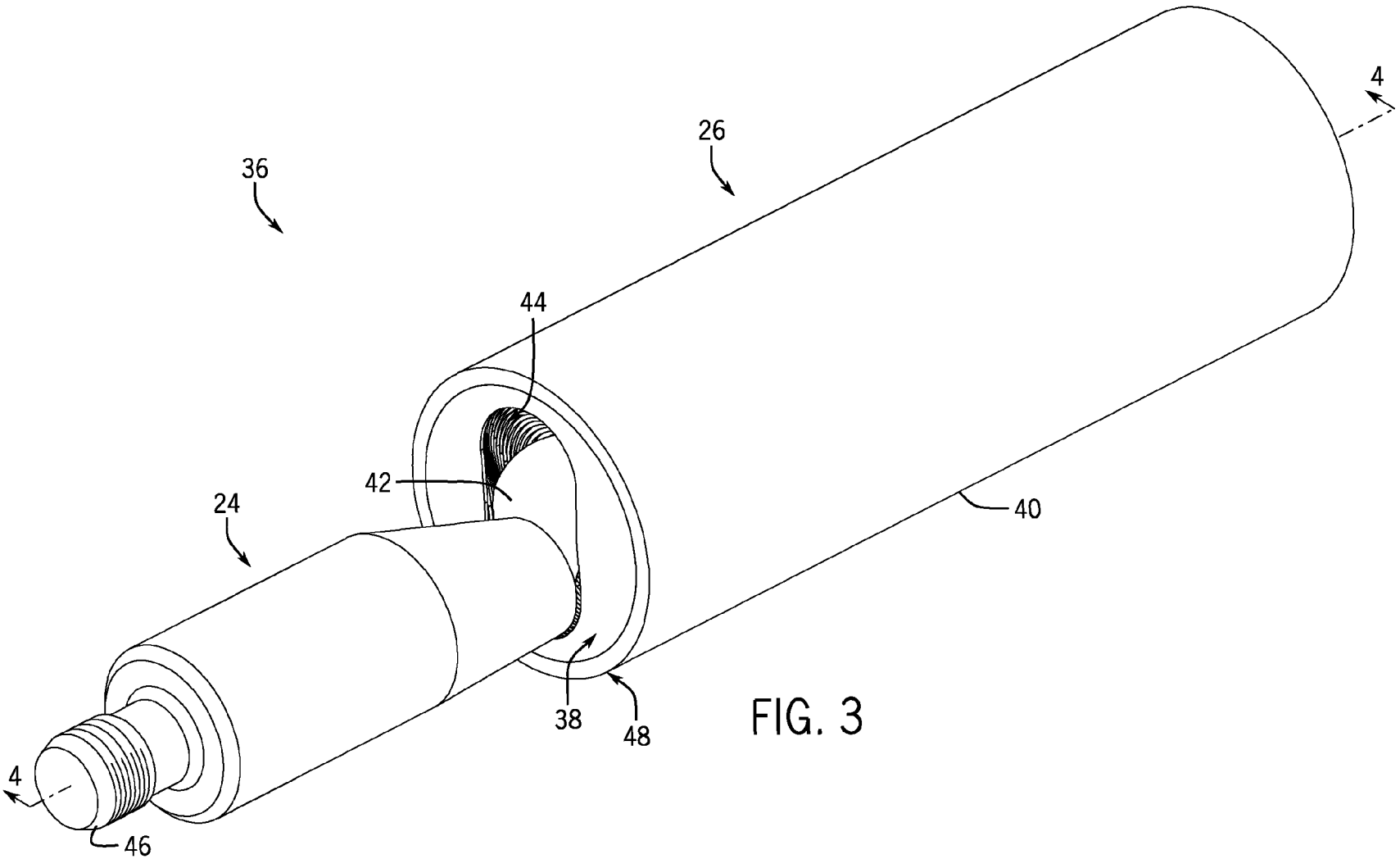
FIG. 3 is a perspective view of a progressing cavity device provided in the form of a progressing cavity pump in accordance with one embodiment.

One example of a progressing cavity device 22 is depicted in FIG. 3 in the form of a progressing cavity pump 36. The stator 26 of the pump 36 includes a stator core 38 installed within a housing 40. In at least some embodiments, the stator core 38 and the housing 40 are both formed entirely from metal. In the presently illustrated embodiment, the stator core 38 includes a series of plates (here depicted as discs) with elongated apertures, and the housing 40 is a hollow tube that receives the plates of the stator core 38. It will also be appreciated that other arrangements could instead be used. For example, the plates could be provided in some other (non-disc) shape, the housing 40 could be provided in a different shape, or the housing 40 could be omitted from the pump 36.

The rotor 24 includes a helical profile 42 (which may also be considered to include a spiraled tooth for engaging the stator 26) positioned within a rotor cavity 44 of the stator core 38. As described in greater detail below, the rotor cavity 44 is formed by the elongated apertures in the plates of the stator core 38. Individual plates of the stator core 38 are rotationally offset with one another such that the apertures of the series of plates form a helically wound rotor cavity 44 for receiving a contoured portion of the rotor 24 having the helical profile 42. The rotor 24 and the stator 26 may be connected to other equipment in any suitable manner. For instance, the rotor 24 depicted in FIG. 3 includes a threaded connection end 46 that facilitates coupling to an input shaft (e.g., the drive string 32 in a wellbore environment). The stator 26 could be attached to a production tubing string in the well 12 in some embodiments, such as by threading an end 48 of the stator 26 and connecting it to the production tubing string with a threaded collar or sub. But the stator 26 could instead be secured within the well 12 in other ways. And while the pump 36 is presently described in connection with downhole applications, it will be appreciated that the pump 36 could be used outside of a wellbore.

Figure 4:
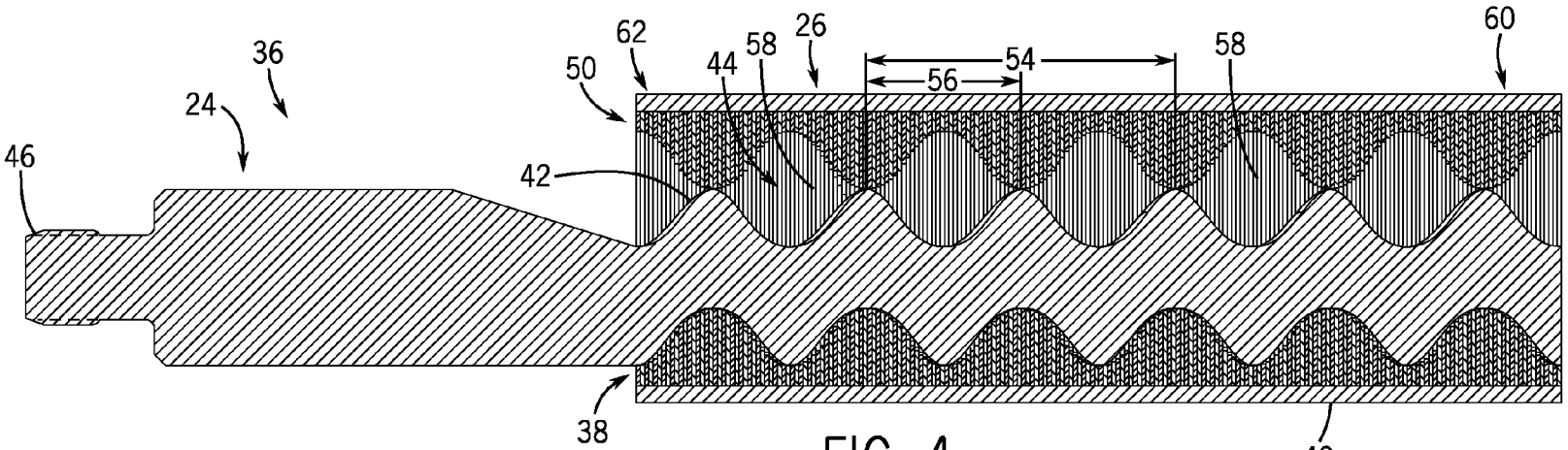
FIGS. 4 and 5 are cross-sections generally depicting certain features of the progressing cavity pump of FIG. 3, including a series of discs that form a stator core of the pump.
Figure 5:
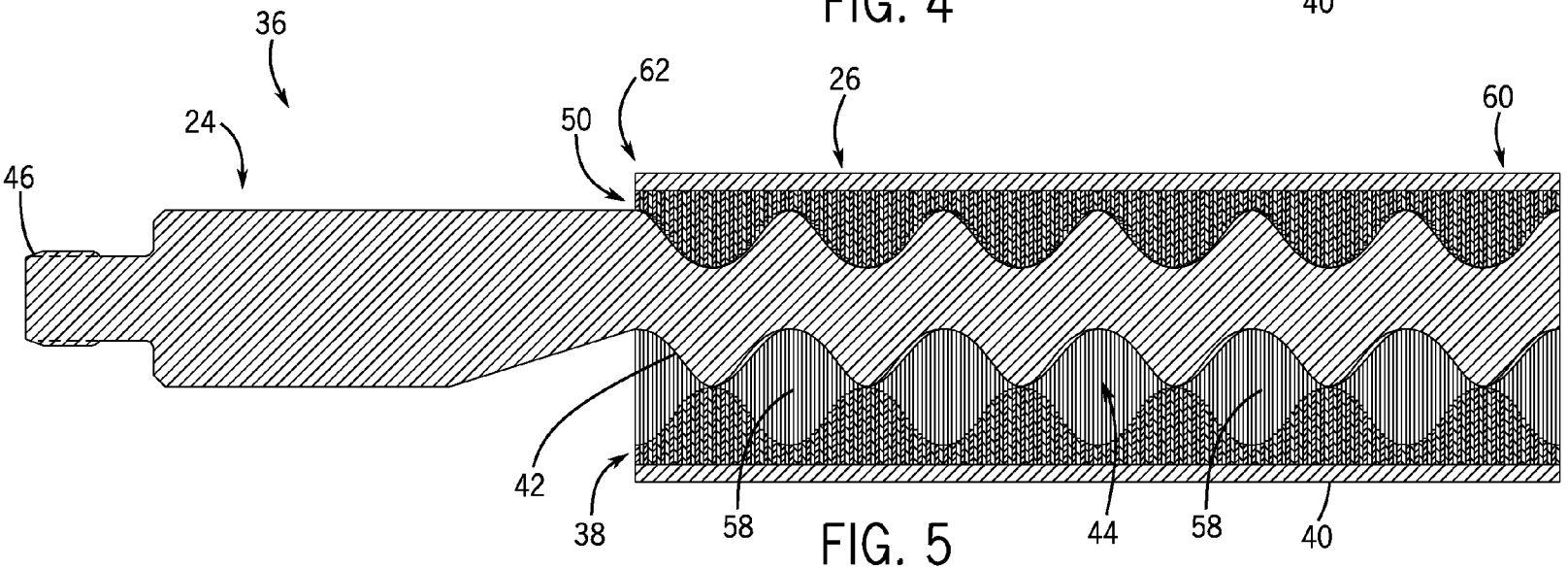

Operation of the pump 36 may be better understood with reference to the cross-sections depicted in FIGS. 4 and 5. As shown in these figures, the stator core 38 includes a series of discs denoted with reference numeral 50. The discs of the series 50 are rotationally offset with respect to one another such that the ends of the elongated apertures in the discs generally define two teeth or ridges (corresponding to opposite sides of the discs about their apertures) that wind through the stator core 38 in the form of a double helix. In the presently depicted embodiment, in which a single-toothed rotor 24 cooperates with a double-toothed stator 26, the pump 36 is a single-lobe pump. But the pump 36 could be provided as a multiple-lobe pump in other embodiments.

With reference to FIG. 4, the winding rotor cavity 44 of the stator 26 includes a stator pitch 54. In the present single-lobe arrangement, the helical profile 42 of the rotor 24 includes a rotor pitch 56 that is half that of the stator pitch 54. The rotor 24 can be rotated (e.g., by the drive string 32 attached to a connection end 46 of the rotor 24) within the cavity 44 to draw fluids through the stator 26. In operation, the rotor 24 seals against the inner winding surface of the stator 26 to retain fluid within individual chambers or cavities 58 of the rotor cavity 44 between the rotor 24 and the stator 26. These fluid cavities 58, upon rotation of the rotor 24, progress in winding fashion about the rotor 24 and through the stator 26 from an intake end 60 to a discharge end 62 such that fluid is drawn through the stator 26 at a rate that varies based on the rotational speed of the rotor 24 about its axis. In at least some embodiments, the rotor 24 and the stator 26 are both formed with metal to provide a metal-to-metal interface between these two components during operation. Although described herein as being able to convert rotation of the rotor 24 into fluid flow, the pump 36 could instead be arranged to perform the reverse; that is, to convert fluid flow into rotation of a component. In such a variation, the pump 36 could serve as a downhole mud motor or some other device.

FIG. 5 generally depicts the rotor 24 having been turned by 180 degrees from its position in FIG. 4. At both of these depicted positions of the rotor 24 within the stator 26, the rotational axis of the rotor 24 differs from the central axis of the stator. As the rotor 24 is driven about its own axis (e.g., by drive string 32), it also rotates eccentrically with respect to the axis of the stator 26 due to engagement of the helical profile 42 with the inner surface of the stator 26. It is also noted that while the pump 36 is configured as a right-handed device (with a right-handed helical profile of the rotor 24), other progressing cavity devices 22 could instead be configured as left-handed devices with rotors 24 having left-handed helical profiles that wind in a direction opposite that of the rotor 24 of pump 36.

Figure 6:
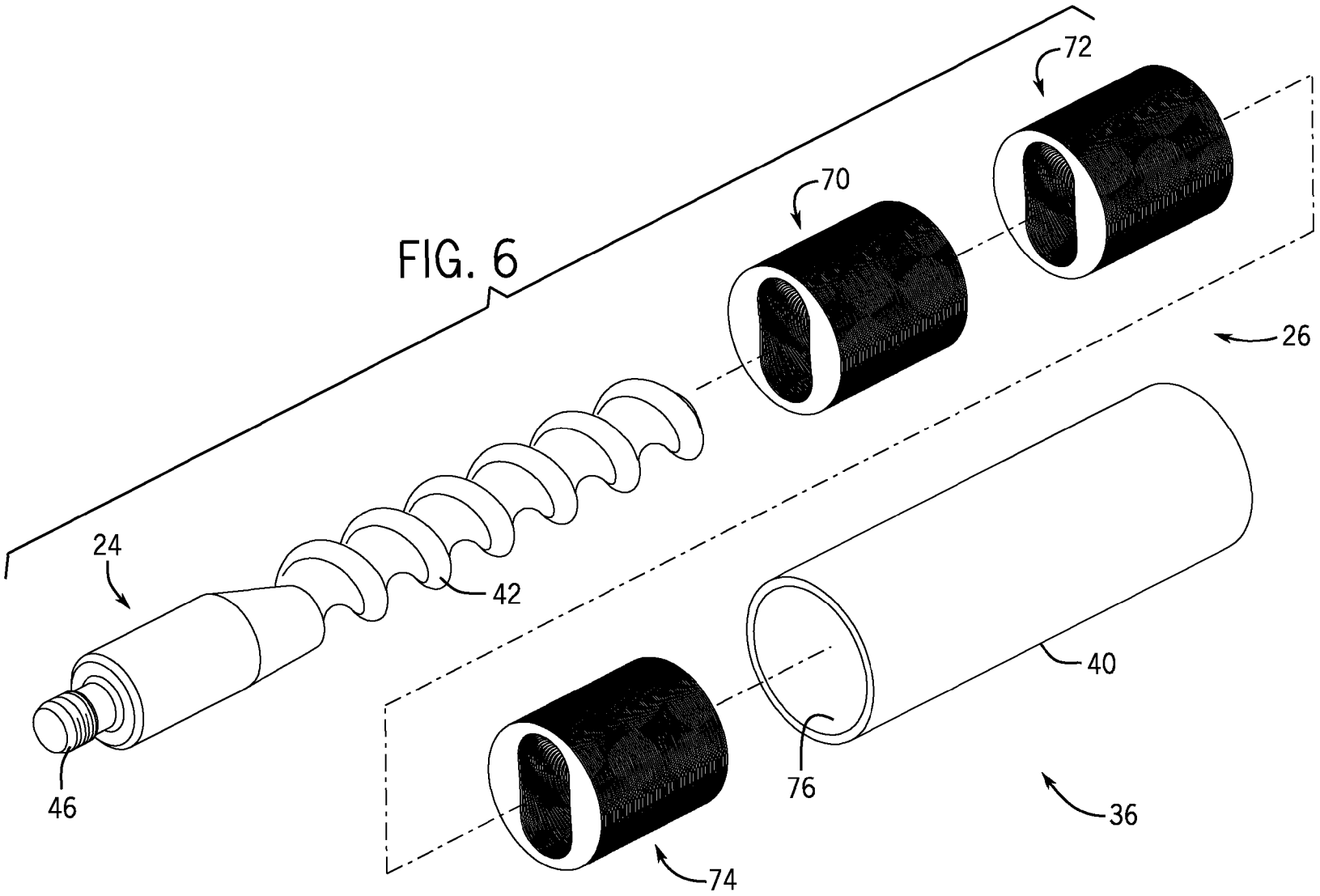
FIG. 6 is an exploded view of the progressing cavity pump depicted in FIGS. 3-5.

By way of further example, an exploded view of the pump 36 is depicted in FIG. 6. In this illustration, the discs of the stator core are shown as divided into three equal disc sets 70, 72, and 74. These disc sets can be installed in the bore 76 of the housing 40 and retained in any suitable fashion. For example, the sets 70, 72, and 74 could be bonded to the housing 40, retained by an interference fit, or retained by end caps coupled to the housing 40. Additionally, the discs can also be joined to one another prior to installation in the housing 40, such as through welding or bonding. The rotor 24 can then be inserted into the assembled stator 26 as generally depicted in FIG. 3.

Figure 7:
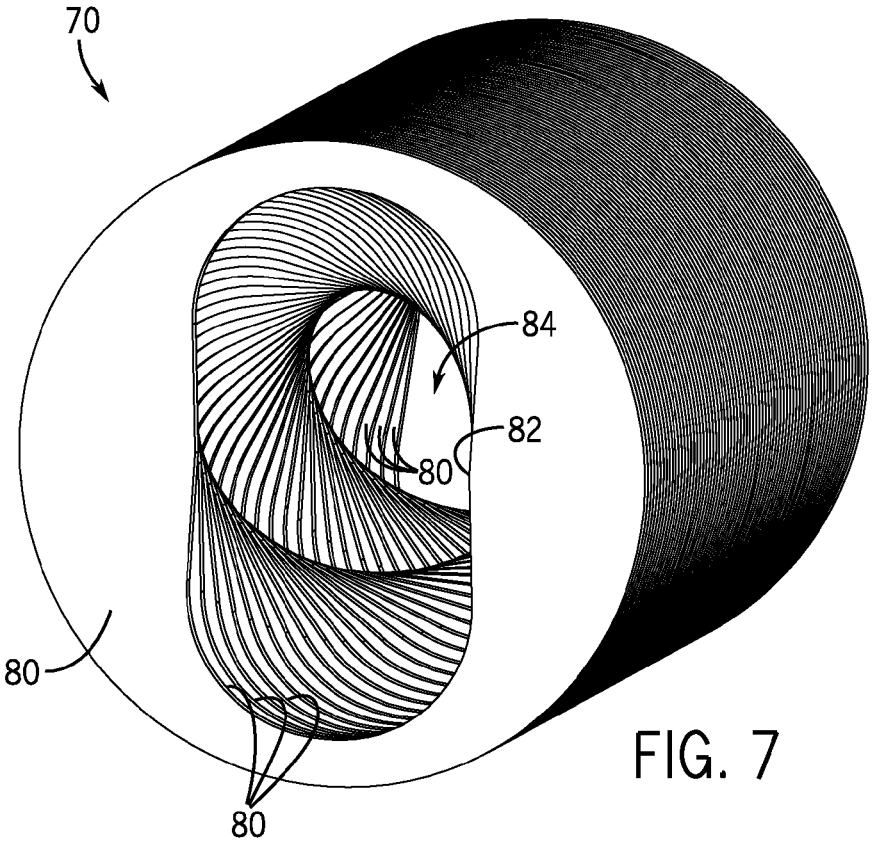
FIGS. 7 and 8 generally depict a set of discs of the stator core of the pump of FIGS. 3-6.
Figure 8:
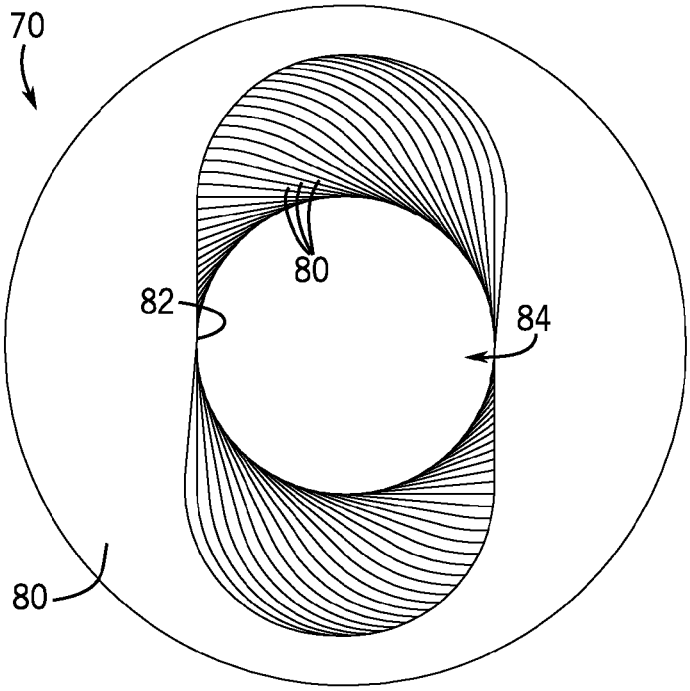

One example of the disc sets of FIG. 6 is depicted in greater detail in the perspective and front elevational views of FIGS. 7 and 8. While this example is generally referred to as disc set 70 having individual discs 80, it will be appreciated that the following description of disc set 70 is generally applicable to the disc sets 72 and 74 as well. As depicted in FIG. 6, each of the disc sets 70, 72, and 74 represents one full lead (i.e., having a length equal to the stator pitch 54) of the stator core 38 in the present embodiment. That is, with reference to FIGS. 7 and 8, each disc 80 of the set is rotationally offset with respect to its neighbor to wind through a full turn of a portion 84 of the rotor cavity 44 formed by elongated apertures 82 in the discs of the set. The pump 36 is depicted in FIGS. 3-6 as having stator core 38 with a length that is three times the stator pitch 54. But it is noted that the pump 36 could have a stator core 38 of any desired length. And while the stator cores 38 in these other embodiments could have lengths that are integer multiples of the stator pitch 54, the stator cores 38 could have lengths that are not such multiples.

In the present embodiment, each disc set 70, 72, and 74 includes seventy-two individual discs 80. The discs 80 of each set are rotationally staggered at five-degree intervals such that the seventy-two discs compose a full lead of the stator core 38. In one embodiment, each disc 80 is one-sixteenth of an inch thick (about 1.6 mm), but the thickness and other dimensions of the discs (like those of the other components of progressing cavity devices 22) can vary between different embodiments depending on the intended application. Further, the number of discs per lead can also differ, as can the length of each lead and the extent of rotational offset between each disc. For instance, in another embodiment, each lead of the stator core could include ninety discs with a four-degree rotational stagger between neighboring discs. More generally, the number of discs per lead can be determined by dividing the lead length by the thickness of each disc, and the rotational offset can be determined by dividing 360 degrees by the number of discs per lead.

Figure 9:
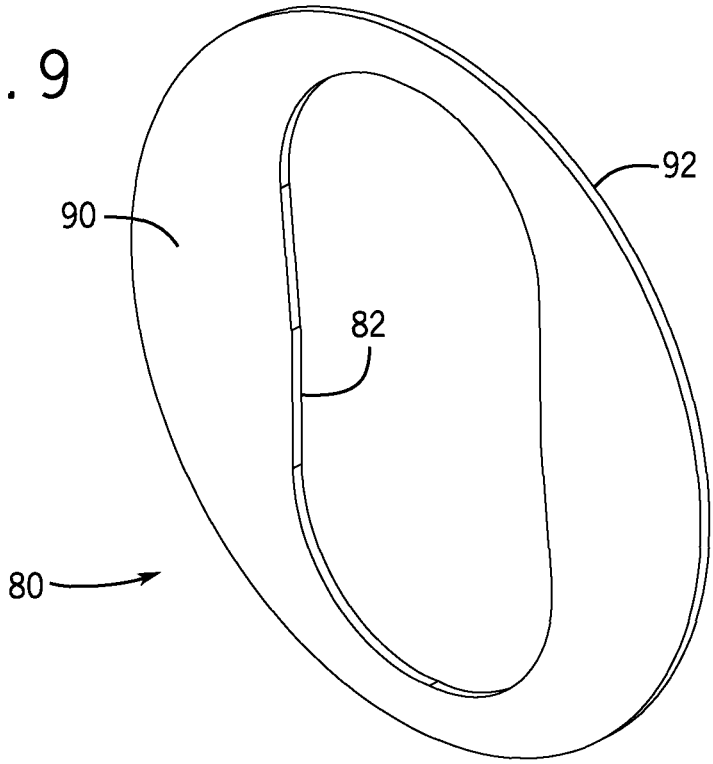
FIGS. 9 and 10 depict an individual disc representative of the discs of the stator core of FIGS. 7 and 8.
Figure 10:
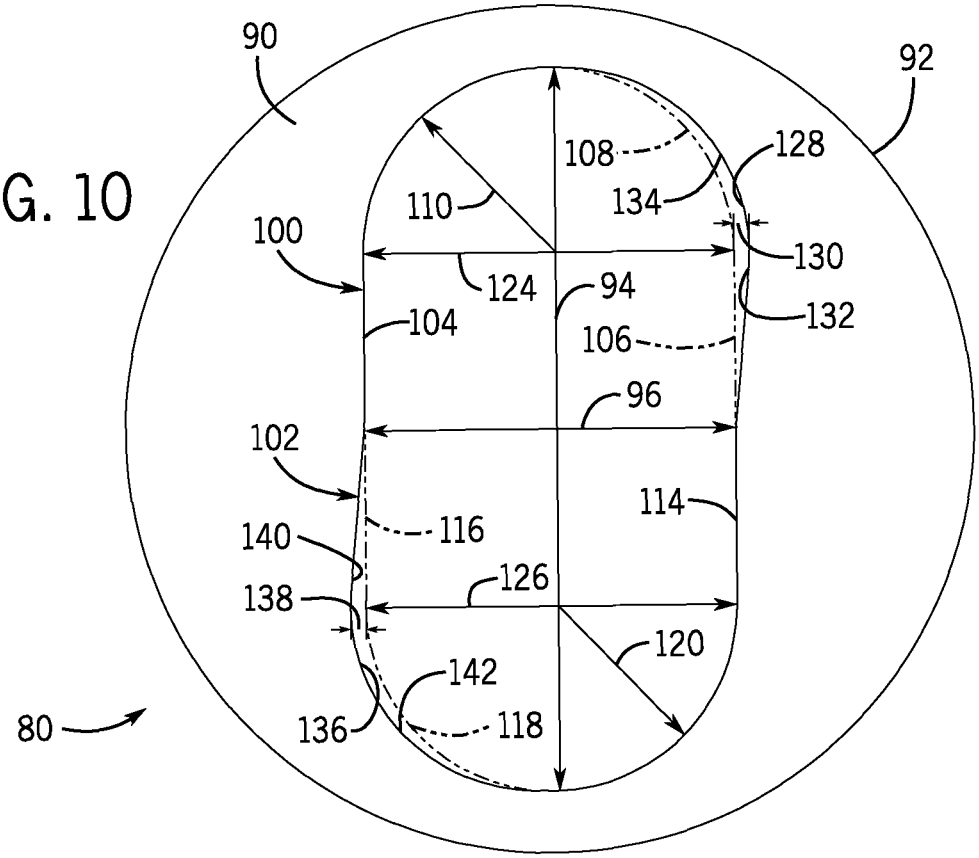

Certain features of an individual disc 80 may be better appreciated with reference to FIGS. 9 and 10. As shown in these figures, each individual disc 80 includes a body 90 having a circumferential edge 92 and the elongated aperture 82. The aperture 82 can be cut from the body 90 via laser cutting in some embodiments, or can be formed through any other suitable manufacturing techniques (e.g., stamping). As shown in FIG. 10, the aperture 82 of the disc 80 has a generally oval shape with a major axis 94 and an orthogonal minor axis 96. The aperture 82 can be considered as having portions 100 and 102 on opposite sides of the minor axis 96.

If the aperture 82 were formed as an oval with semi-circular ends joined to each other by two sides provided at a constant distance apart and each parallel with the major axis of the aperture 82, the portion 100 of the aperture 82 would have sides 104 and 106 parallel to one another and joined by a curved end 108 with a radius of curvature 110. Similarly, the portion 102 would include sides 114 and 116 parallel to one another (and in-line with the sides 106 and 104, respectively) and connected by a curved end 118 with a radius of curvature 120 equal to the radius of curvature 110. In such an arrangement, which may also be referred to as the hypothetical oval aperture, the aperture would have a constant width (generally corresponding to the equal widths 124 and 126 measured parallel to the minor axis 96 and depicted in FIG. 10) between the parallel sides equal to the minor axis of the aperture. Such an aperture would exhibit both line symmetry (about the minor axis) and rotational symmetry.

Due to the rotational offset of the discs 80 in the stator core 38, the rotor cavity 44 has a stepped profile generally defined by the inner surfaces of the apertures 82. Additionally, if the apertures 82 were formed as the hypothetical ovals described above, the stepped profile of two adjoining discs would require the diameter of the rotor 24 to be sized smaller than the width of the aperture (between the two parallel sides) in order to fit through the combined profile of the two adjoining discs, as the first disc would partially obscure the aperture of the second disc. And because the extent of such obscuring is greater toward the curved ends of the apertures than at the middle (e.g., at the minor axis), such reduction in the rotor diameter can significantly reduce operating efficiency of the pump (e.g., resulting in an efficiency of about twenty percent) by causing a loose fit between the rotor and stator and allowing excessive fluid slippage between the narrowed rotor and the wider portions of the rotor cavity corresponding to the middles of the combined profiles of adjoining apertures.

But in at least some embodiments of the present technique, such as that depicted in FIG. 10, the profile of the aperture 82 includes deviations 128 and 136 from the hypothetical oval having two parallel sides a constant distance apart. These deviations cause the aperture 82 to be wider at parts of the portions 100 and 102 (by respective distances 130 and 138) than at the middle of the aperture 82 (e.g., along the minor axis 96 in the present figure). As such, the aperture 82 can be said to have an elongated profile with enlarged ends. The enlarged ends can be formed by overcutting the aperture (compared to the sides 106 and 116 of the hypothetical oval aperture described above) to include the deviations 128 and 136. As used herein, the term "overcutting" is used to refer to providing one or more enlarged portions of the aperture as described above through any manufacturing technique. That is, overcutting as used herein does not require cutting; rather, the aperture could instead be formed by stamping or some other technique. And although the deviations 128 and 136 are depicted by way of example, it will be appreciated that the aperture 82 can include other deviations instead of or in addition to those presently illustrated.

Returning now to FIG. 10, the portion 100 includes a side 132 (rather than the side 106) angled outwardly with respect to the side 114, which is parallel to the major axis 94. A curved edge 134 connects the side 132 with the side 104 and sweeps wider than the radius of curvature 110 on the right hand side of the portion 100 in FIG. 10 to accommodate the outward deflection of the side 132. Likewise, the portion 102 includes a side 140 (rather than the side 116) angled outwardly with respect to the side 104 (itself parallel to the major axis 94), and is connected to the side 114 by a curved edge 142, which sweeps wider than the radius of curvature 120 on the left hand side of the portion 102 in FIG. 10. As the sides 132 and 140 are angled outwardly with respect to sides 114 and 104, the pair of sides 114 and 132 and the pair of sides 104 and 140 can be referred to as doglegged sides of the aperture 82. As depicted in FIG. 10, the deviations 128 and 136 cause the elongated aperture 82 to have rotational symmetry (the aperture 82 looks the same if rotated 180 degrees) while lacking line symmetry.

In at least some embodiments, the angle of deviation of the sides 132 and 140 from the sides 114 and 104 is equal to the rotational offset of neighboring discs 80 (i.e., five degrees in the presently depicted embodiment). The added width across the ends of the apertures—corresponding to the width 124 plus the distance 130 for the portion 100 and the width 126 plus the distance 138 for the portion 102—provides a combined profile of two apertures of adjacent discs that allows the use of a larger rotor compared to that which would fit between adjacent discs having the hypothetical oval apertures described above. This, in turn, reduces slippage and increases efficiency of the pump 36.

Figure 11:
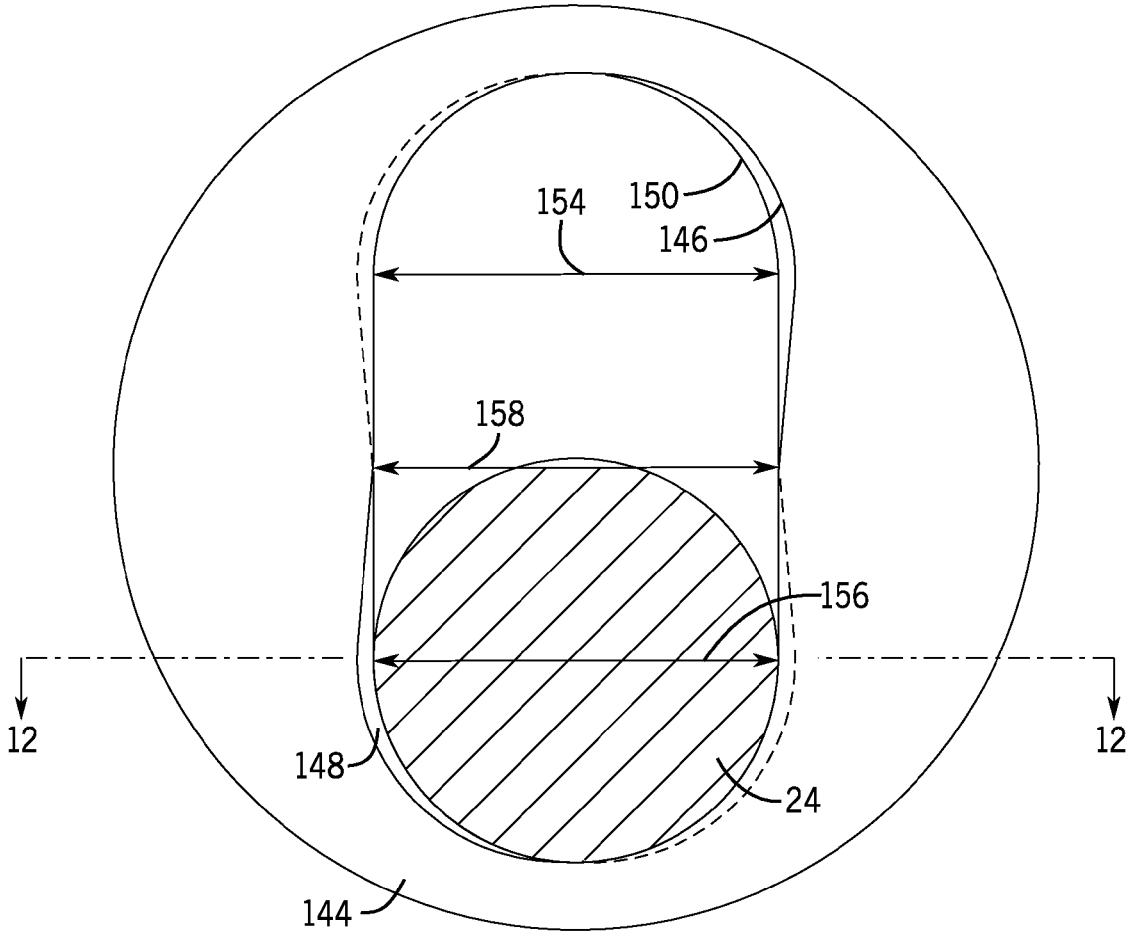
FIGS. 11 and 12 generally illustrate a pair of adjoining discs of the stator core that receive a rotor of the pump of FIGS. 3-6 in accordance with one embodiment.
Figure 12:
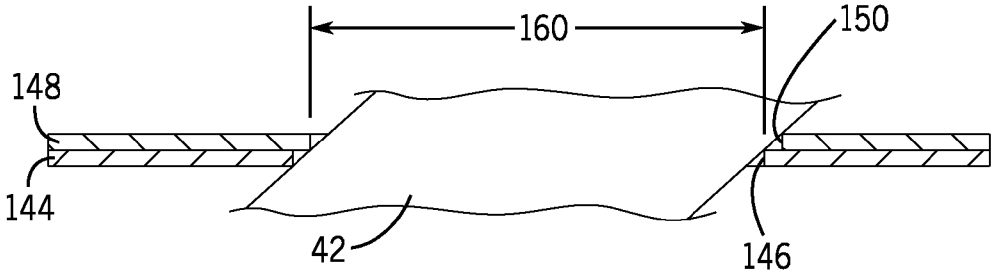

An arrangement showing two adjacent discs and a portion of the rotor 24 received in the discs is generally illustrated in FIGS. 11 and 12. These figures depict two adjacent discs 80, denoted in FIGS. 11 and 12 as discs 144 and 148 having respective apertures 146 and 150. In FIG. 11, the front disc 144 partially obscures the aperture 150 of the rear disc 148 (with the obscured edges of the aperture 150 shown in phantom). While each of the apertures 146 and 150 includes enlarged ends with widths larger than that of the minor axis of the aperture as described above with respect to aperture 82, the coextensive area of the two apertures (i.e., the area of each aperture 146 and 150 that overlaps with the other, equivalent here to the portion of the aperture 150 that is not obscured by the disc 144) has end widths 154 and 156 substantially equal to one another and at least closer to the width 158 along the minor axis of the overlapping areas than would be the case with the hypothetical oval apertures described above. This allows the helical profile 42 of the rotor 24 to have a larger diameter than would be possible with discs having the hypothetical oval apertures. Consequently, such an arrangement enables tighter tolerances between the rotor 24 and the stator 26 and thus improves the efficiency of the pump 36 (or other device 22).

By way of further example, as shown in FIG. 12, the helical profile 42 of the rotor 24 has a cross-sectional diameter 160 in an axial plane defined by the interface between the discs 144 and 148. In some embodiments, the diameter 160 of the helical profile 42 is substantially equal to the width 158 such that the helical profile 42 can simultaneously seal against opposite sides of the coextensive area when the helical profile 42 is centered within the coextensive area. And in at least one embodiment, the diameter 160 is substantially equal to each of the widths 154, 156, and 158 to increase the operating efficiency of the pump 36.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. The presently disclosed techniques may be applied to other progressing cavity devices, such as to mud motors or other devices that use fluid flow to drive rotation of a component (rather than driving rotation of the rotor to cause fluid flow). The invention is to cover all modifications, equivalents, and alternatives falling within the spirit and scope of the invention as defined by the following appended claims.

The invention claimed is:

1. A system comprising:

a metal stator of a progressing cavity device, the metal stator including a plurality of metal plates with apertures that are rotationally offset to form a winding rotor cavity, wherein at least one of the apertures that form the winding rotor cavity has an elongated profile with a major axis, a minor axis, and enlarged ends having widths greater than that of the minor axis across the middle of the at least one aperture, and wherein the at least one aperture exhibits rotational symmetry but not line symmetry.

2. The system of claim 1, wherein the winding rotor cavity includes a stepped profile due to the rotational offsetting of the apertures of the metal plates.

3. The system of claim 1, wherein the at least one aperture has doglegged sides.

4. The system of claim 1, wherein the metal plates comprise metal discs.

5. The system of claim 4, comprising a metal tube housing the plurality of metal discs.

6. The system of claim 1, comprising a rotor.

7. The system of claim 6, wherein the rotor has an axial cross-section having a width substantially equal to that of the width across the middle of the at least one aperture.

8. The system of claim 6, wherein the rotor and the stator are constructed to form a metal-to-metal interface between the rotor and the stator during operation of the progressing cavity device.

9. The system of claim 1, wherein the progressing cavity device is a single-lobe device.

10. The system of claim 1, wherein the progressing cavity device is a progressing cavity pump.

11. The system of claim 1, comprising an oilfield apparatus including the progressing cavity device.

12. A system comprising:

a metal plate of a progressing cavity stator, the metal plate including an aperture for receiving a rotor, the aperture having a major axis and a minor axis, wherein the width of the aperture measured perpendicular to the major axis is narrower along the minor axis than at some other portions of the aperture, the minor axis divides the aperture into a first end and a second end, and each of the first and second ends includes one side parallel to the major axis of the aperture and an opposite side that deviates outwardly from the major axis.

13. The system of claim 12, comprising a progressing cavity device including the progressing cavity stator and the rotor.

14. The system of claim 13, wherein the progressing cavity device is a progressing cavity pump.

15. A method comprising:

forming rotor apertures in metal plates of a progressing cavity stator such that the rotor apertures have major axes and minor axes and are wider across ends of the rotor apertures than at the minor axes across the middles of the rotor apertures, and such that the rotor apertures exhibit rotational symmetry but not line symmetry; and assembling the progressing cavity stator with the metal plates.

16. The method of claim 15, wherein forming the rotor apertures in the metal plates includes overcutting a side of a first end of each rotor aperture and overcutting a side of a second end of each rotor aperture compared to an oval with parallel sides.

17. The method of claim 15, wherein forming the rotor apertures includes laser cutting the rotor apertures.

18. The method of claim 15, wherein assembling the progressing cavity stator with the metal plates includes installing the metal plates inside of a stator housing.

* * * * *